US006318323B2

(12) United States Patent
Speil

(10) Patent No.: US 6,318,323 B2
(45) Date of Patent: Nov. 20, 2001

(54) TAPPET FOR A VALVE MECHANISM OF AN INTERNAL COMBUSTION ENGINE

(75) Inventor: Walter Speil, Ingolstadt (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/331,335

(22) PCT Filed: Jul. 25, 1997

(86) PCT No.: PCT/EP97/04048

§ 371 Date: Jun. 17, 1999

§ 102(e) Date: Jun. 17, 1999

(87) PCT Pub. No.: WO98/28522

PCT Pub. Date: Jul. 2, 1998

(30) Foreign Application Priority Data

Dec. 20, 1996 (DE) ..... 196 53 459

(51) Int. Cl.[7] ..... F01L 1/14

(52) U.S. Cl. ..... 123/90.48; 123/90.16; 123/90.57

(58) Field of Search ..... 123/90.16, 90.19, 123/90.36, 90.48, 90.49, 90.55, 90.57

(56) References Cited

FOREIGN PATENT DOCUMENTS

3917226 * 1/1990 (DE) .
4111610 * 1/1992 (DE) .
4405189 * 8/1995 (DE) .
6062616 * 4/1985 (JP) .

* cited by examiner

*Primary Examiner*—Thomas Denion
*Assistant Examiner*—Tu M. Nguyen
(74) *Attorney, Agent, or Firm*—Bierman, Muserlian and Lucas

(57) ABSTRACT

A tappet (1) with a hydraulic clearance compensation element (7), a positive opening of a one-way valve (15) being effected during a base circle region α of the contacting cam (5) whereby a closing member (16) of the one-way valve (15) is loaded by an adjusting element (21), the adjusting element (21) extends through a bottom (3) of the tappet (1) and cooperates with a groove (22) on the outer peripheral surface (23) of the cam (5), the groove (22) extends over the entire periphery of the cam (5) with the exception of its base circle region so that when the base circle region α comes to be situated opposite the bottom (3), a positive opening of the closing member (16) is effected whereby no undesired relieving of the gas exchange valve actuated by the tappet (1) nor its opening due to a transmission of undesired opening movements from the cam (5) to the clearance compensation element (7) can occur in the base circle region α of the cam (5).

9 Claims, 1 Drawing Sheet

TAPPET FOR A VALVE MECHANISM OF AN INTERNAL COMBUSTION ENGINE

FIELD OF THE INVENTION

The invention concerns a tappet for a valve train of an internal combustion engine according to the features of the preamble of claim 1.

BACKGROUND OF THE INVENTION

A tappet of the pre-cited type is disclosed in DE-OS 41 11 610. An adjusting element extends through a bottom of the tappet and acts at one end on a closing member of a one-way valve of a clearance compensation element and cooperates at the other end with a groove on the outer peripheral surface of a contacting cam. This groove is arranged only on a small part of the outer peripheral surface of the cam and extends on both sides of the cam tip in the region of a lift-producing run-on and run-off flank of the cam. By an opening of the closing member outside of the region of the groove of the cam, it is intended to achieve any desired timing for valve intake and discharge. A more particular goal is to obtain an automatic shifting of the point of time of closing of the gas exchange valve concerned as a function of the engine speed.

However, this prior art document gives no incentive to the person skilled in the art as to how to relieve a high pressure chamber of the clearance compensation element during the cam base circle phase with the disclosed means in order to protect the gas exchange valve from camshaft displacements, torsional vibrations of the camshaft and other factors of influence such as circularity errors of the cam base circle which in the most unfavorable of cases can lead to the opening of the gas exchange valve concerned during the base circle phase.

OBJECT OF THE INVENTION

The object of the invention is therefore to create a tappet of the pre-cited type in which the aforesaid drawbacks are eliminated and, in particular, an undesired opening of its gas exchange valve during a base circle phase is avoided by the use of simple means.

SUMMARY OF THE INVENTION

The novel tappet of the invention for a valve train of an internal combustion engine, which tappet oscillates with its skirt in a bore of a cylinder head and is contacted on a top surface of its bottom by a cam of a camshaft, a hydraulic clearance compensation element being fixed against an undersurface of the bottom by a bushing which is in contact by one of its peripheral surfaces with a pressure piston that is axially displaceable relative to the bushing, a bottom of the pressure piston faces at least one gas exchange valve, a high pressure chamber (13) is arranged axially between the bottom and an annular shoulder of the bushing and a reservoir for hydraulic medium is arranged preferably axially between the annular shoulder and the bottom, the annular shoulder having at least one passage which is closed on a side nearer the high pressure chamber by a one-way valve which opens towards the high pressure chamber, a closing member of the one-way valve is biased towards the reservoir by a spring means, and the closing member can be displaced toward the bottom by an adjusting element which extends through an opening of the bottom and cooperates with a groove on the outer peripheral surface of the cam, is characterized in that the groove extends over an entire outer peripheral surface of the cam with the exception of its base circle region $\alpha$, and the groove has a depth so that the adjusting element extending in the groove releases the closing member so that the closing member bears against the passage due to the force of its spring means, and the force of the spring means has a magnitude so that for opening the closing member in the base circle phase of the cam, a hydraulic medium differential pressure of $\Delta p \geqq 0.4$ bar is required at the cross-section A of the passage.

Due to the fact that the groove of the cam extends over the entire outer peripheral surface thereof with the exception of the base circle region, the one-way valve of the clearance compensation element is defined and positively opened. Due to this "opening", the high pressure chamber and a reservoir of the clearance compensation element are in hydraulic communication with each other. As known, per se, to the person skilled in the art, possible displacements or torsional vibrations of the camshaft and circularity errors in the cam base circle no longer lead to an undesired stiffening of the high pressure chamber and an eventual relieving of the gas exchange valve loaded in closing direction, or even to an opening of the gas exchange valve. The invention, however, likewise covers solutions in which the groove of the cam also extends in parts of its base circle region.

During the aforementioned positive opening, clearance formed during the lifting phase of the gas exchange valve can be compensated in a known manner by a regulation of the quantity of hydraulic medium. At the same time, an undesired build-up of high pressure in the high pressure chamber during the base circle phase is prevented. Retroaction of additional cams, such as cams of fuel injection pumps, on the hydraulic clearance compensation during the base circle phase of the camshaft is likewise prevented. It is further known that relatively large dilatations of the exhaust valve occur particularly in transient operation, i.e. during a rapid acceleration of the internal combustion engine immediately upon its start. If it comes to the worst, it is also possible that the clearance compensation element cannot compensate for these length variations by its leak function and the gas exchange valve remains partly open during the base circle of the cam. This drawback, too, can be eliminated in a simple manner by the means provided by the invention.

According to a further feature of the main claim, the spring force of the spring means acting on the closing member is designed to be substantially larger than that of prior art spring means. In this way, the sealing action of the one-way valve is clearly enhanced also, and more particularly, at rapid accelerations of the tappet. It has been determined that no minimum hydraulic medium pressure from the reservoir is required for opening the closing member against the force of the spring means. Since this minimum pressure in prior art cup tappets is relatively low, for example in the idle running range, the force of the spring means for the one-way valve also had to be relatively small in order to assure a proper clearance compensating function of the clearance compensation element even in the idle running range. The proposed higher spring force of the spring means also assures a faster and more reliable closing of the one-way valve when cam lift starts. At the same time, it is also possible to realize a clearly larger stroke of the closing member compared to the prior art strokes so that, immediately upon a starting of the base circle phase, a relatively large flow cross-section is established on the valve by the adjusting element. At the same time, the hitherto required relatively close tolerances with regard to the stroke of the closing member can be relaxed and this is particularly favorable from the manufacturing point of view.

The proposed relatively high spring force of the spring means for the closing member necessitates a hydraulic medium differential pressure of $\Delta p \geqq 0.4$ bar for opening the closing member in the base circle phase of the cam, while, due to the just described situation, the maximum differential pressures realized in the prior art were $\leqq 0.2$ bar. This pressure is measured at the passage for the closing member but without taking into account the mass forces and other factors of influence which need no further specification here. Thus, the larger the force of the spring means acting on the closing member relative to the dimensions of the tappet, the more reliable is the closing behavior of the closing member.

It is also conceivable to extend the non-recessed portion of the outer peripheral surface of the cam beyond the base circle region into the pre-cam region.

It is likewise possible to shorten a region of the closing ramp of the cam adjoining a run-off flank of the cam (seen in rotating direction of the cam). This is enabled by the measures (positive opening of the one-way valve) provided by the invention because the length of the closing ramp can now be chosen without regard to different sinking values of the clearance compensation element. In this way, the performance or speed of rotation of the internal combustion engine can be favorably influenced because a larger valve opening cross-section is ascertained against time and a period of overlap with an opening ramp of an oppositely acting gas exchange valve of the cylinder is shortened. Prior art closing ramps have a height of approximately 0.1 to 0.2 mm while, according to the invention, the closing ramp has a height of <0.1 mm. Analogous to the height of the opening ramp, this height of <0.1 mm proves to be still necessary for eliminating the compressibility of the clearance compensation element.

According to a further feature of the invention, the spring means is a simple coiled spring and the one-way valve is a ball valve, known, per se. However, it is also conceivable to use other valves like disk valves and the like. The spring means may further be a conical coil spring, a disk spring or any other similar suitable means.

It is particularly advantageous if the opening in the region of the bottom of the cup tappet at the same time comprises an air vent cross-section. In this way, air present in the reservoir can be evacuated in a simple manner through the air vent cross-section. With this cross-section, it is possible at the same time to realize a certain lubrication of the top surface of the bottom during the run-on phase of the cam.

Due to the positive opening of the closing member in the region of the base circle of the cam, air which might be present in the high pressure chamber can also escape to the outside. Thus, it is no longer necessary to arrange the reservoir above the high pressure chamber in axial direction for collecting the escaping air there. This offers a further possibility of minimizing an assembly length between the bottom of the pressure piston and the bottom of the tappet.

Particularly favorable flow conditions are created on the adjusting element in that this has a conical shape starting from the closing member. It is also possible to provide a bevel on an end face of the adjusting element facing the closing member, so that favorable flow conditions for the hydraulic medium are also created on this bevel.

According to a further characterizing feature of the invention, the adjusting element is provided with a securing element such as a disk spring. This disk spring prevents an undesired falling-out of the adjusting element from the interior of the tappet particularly during transportation of the tappet. This spring further prevents undefined axial movements of the adjusting element. Many different types of securing elements may be used, even such as are made in one piece with the adjusting element and other similar securing elements.

It is to be understood, that the invention relates to a variety of hydraulic cam followers and not only to the cup-shaped tappet described herein.

BRIEF DESCRIPTION OF THE DRAWINGS

The invention will now be described more closely with reference to the drawings which show.

DETAILED DESCRIPTION OF THE DRAWINGS

Figure 2:
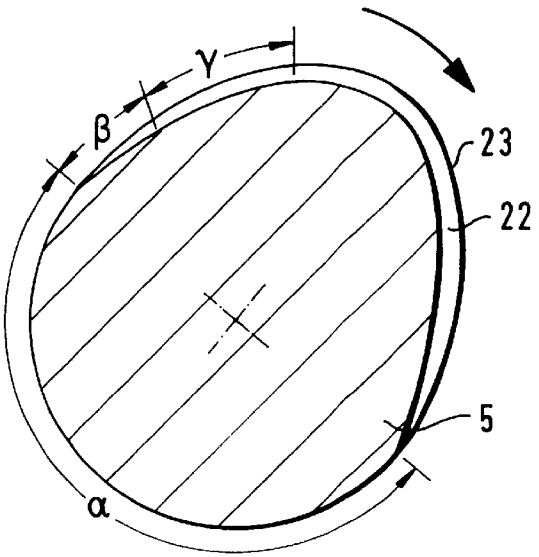
Figure 1:
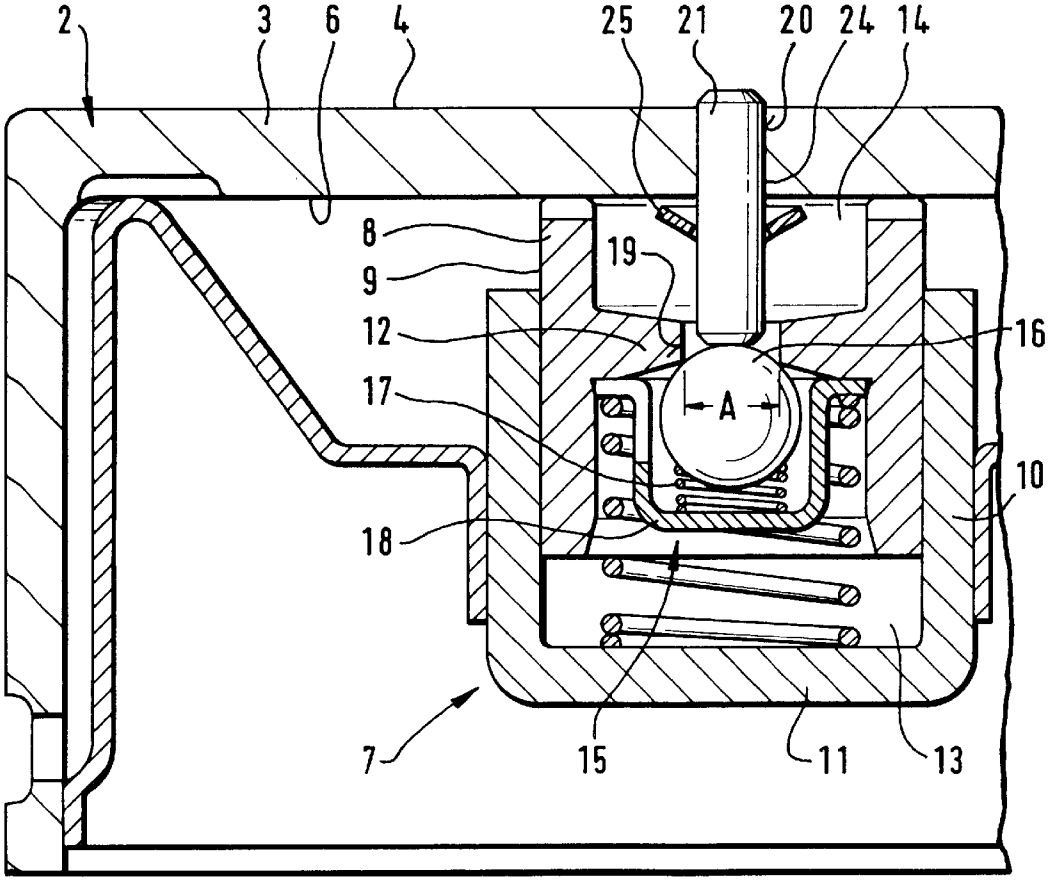
FIG. 1, a partial longitudinal section through a tappet according to the invention, and FIG. 2, a schematic representation of a cam comprising a groove according to the invention.

FIG. 1 shows a tappet 1 whose function does not need further specification in the present context. This tappet 1 comprises a hollow cylindrical skirt 2 with which the tappet 1 oscillates in a bore of a cylinder head of an internal combustion engine (not shown). The skirt 2 is closed at one end by a bottom 3. A top surface 4 of the bottom 3 is contacted in lift direction by a cam 5 provided with a closing ramp (B) adjoining a run-off flank (8) (see also FIG. 2).

A hydraulic clearance compensation element 7 bears centrally against an undersurface 6 of the bottom 3. This clearance compensation element 7 comprises a bushing 8 which extends directly on the undersurface 6. A peripheral surface 9 (outer peripheral surface) of the bushing 8 is partially enclosed by a pressure piston 10. This pressure piston 10 comprises a bottom 11 facing away from the bottom 3. Through this bottom 11, the entire clearance compensation element 7 and thus also the tappet 1 is supported on a gas exchange valve, not shown.

Axially between a radially inward directed annular shoulder 12 of the bushing 8 and the bottom 11, there is arranged a high pressure chamber 13 for hydraulic medium. A reservoir 14 for hydraulic medium is arranged above the annular shoulder 13, between this annular shoulder 13 and the bottom 3.

A one-way valve 15 comprising a closing member 16 in the form of a ball and a spring means 17 is arranged in the high pressure chamber 13. The spring means 17 is supported at one end on a retaining cap 18 and acts at the other end on the closing member 16 in the direction of the bottom 3. In the view of FIG. 1, the closing member 16 closes a passage 19 on the annular shoulder 12. The passage 19 has a cross-section A.

At the same time, an adjusting element 21 configured as a pin extends through a central opening 20 in the bottom 3. This adjusting element 21 acts at one end on the closing member 16 and projects at the other end beyond the top surface 4 of the bottom 3 toward the cam 5. The cam 5, in its turn, possesses, on its outer peripheral surface 23, a groove 22 facing the adjusting element 21. This groove 22 extends outside of a base circle region $\alpha$ of the cam 5 over the entire periphery thereof. The groove 22 has a depth related to a length of the adjusting element 21 so that, when the groove 22 is situated opposite the adjusting element 21, the adjusting element 21 relieves the closing member 16 so that this completely closes the passage 19 which is preferably made as a bore. On the other hand, with a running-on of the base circle region $\alpha$ of the cam 5, the adjusting element 21 is positively displaced toward the bottom 11 of the pressure piston 10 so that a sufficiently large flow cross-section for the hydraulic medium is formed between the closing member 16 and the passage 19. Thus, on the one hand, the quantity of hydraulic medium pressed out of the high pressure chamber 13 during the lift phase of the cam 5 for effecting clearance compensation can be re-sucked in a simple manner into the high pressure chamber 13. On the other hand, due to this positive opening, torsional vibrations of the camshaft, circularity errors of the cam and other factors of influence (see also the introduction of the description) no longer have a detrimental effect on the clearance compensating function of the clearance compensation element 7.

Due to the fact that the closing member 16 leaves the passage 19 open during the entire base circle region a, an undesired stiffening of the high pressure chamber 13 can no longer occur and thus also no relieving of the gas exchange valve or even opening of the gas exchange valve with its known drawbacks is encountered. Moreover, the spring means 17 no longer needs to be compressed via the closing member 16 by the hydraulic medium pressure provided from the reservoir 14 at the cross-section A. As a result, the force of the spring means 17 can be very much higher than the forces of prior art spring means.

A Belleville-type spring washer 25 is arranged within the reservoir 14 on an outer peripheral surface 24 of the adjusting element 21. This washer 25, while permitting an axial movement of the adjusting element 21 toward the bottom 11, prevents the adjusting element 21 from falling out of its opening 20.

What is claimed is:

1. A valve train of an internal combustion engine comprising a tappet (1) loaded by a cam (5) of a camshaft, which tappet (1) oscillates with a skirt (2) in a bore of a cylinder head and is contacted on a top surface (4) of a bottom (3) by the cam (5), a hydraulic clearance compensation element (7) being fixed against an undersurface (6) of the bottom (3) by a bushing (8) which is in contact by one of the bushing's peripheral surfaces (9) with a pressure piston (10) that is axially displaceable relative to the bushing (8), a bottom (11) of the pressure piston (10) faces at least one gas exchange valve, a high pressure chamber (13) is arranged axially between the bottom (11) and an annular shoulder (12) of the bushing (8) and a reservoir (14) for hydraulic medium is, arranged preferably axially between the annular shoulder (12) and the bottom (3), the annular shoulder (12) having at least one passage (19) which is closed on a side nearer the high pressure chamber (13) by a one-way valve (15) which opens towards the high pressure chamber (13), a closing member (16) of the one-way valve (15) is biased towards the reservoir (14) by a spring means (17), and the closing member (16) can be displaced toward the bottom (11) by an adjusting element (21) which extends through an opening (20) of the bottom (3) and cooperates with a groove (22) on the outer peripheral surface (23) of the cam (5), characterized in that the groove (22) extends over the entire outer peripheral surface (23) of the cam (5) with the exception of a base circle region $\alpha$, and the groove (22) has a depth so that the adjusting element (21) extending in the groove (22) releases the closing member (16) so that the closing member (16) bears against the passage (19) due to the force of the spring means (17);

the force of the spring means (17) has a magnitude so that for opening the closing member (16) during contact of the base circle region $\alpha$ of the cam (5), a hydraulic medium differential pressure of $\Delta p \geqq 0.4$ bar is required at the cross-section A of the passage (19); and a closing ramp ($\beta$) adjoining a run-off flank ($\gamma$) of the cam (5), as seen in rotating direction of the cam (5), has a height of <0.1 mm.

2. A valve train of an internal combustion engine with a means for avoiding high pressure in a high pressure chamber of a tappet during base circle operation of the engine, comprising a tappet (1) loaded by a cam (5) of a camshaft, which tappet (1) oscillates with a skirt (2) in a bore of a cylinder head and is contacted on a top surface (4) of a bottom (3) by the cam (5), a hydraulic clearance compensation element (7) being fixed against an undersurface (6) of the bottom (3) by a bushing (8) which is in contact by one of the bushing's peripheral surfaces (9) with a pressure piston (10) that is axially displaceable relative to the bushing (8), a bottom (11) of the pressure piston (10) faces at least one gas exchange valve, a high pressure chamber (13) is arranged axially between the bottom (11) and an annular shoulder (12) of the bushing (8) and a reservoir (14) for hydraulic medium is arranged preferably axially between the annular shoulder (12) and the bottom (3), the annular shoulder (12) having at least one passage (19) which is closed on a side nearer the high pressure chamber (13) by a one-way valve (15) which opens towards the high pressure chamber (13), a closing member (16) of the one-way valve (15) is biased towards the reservoir (14) by a spring means (17), and the closing member (16) can be displaced toward the bottom (11) by an adjusting element (21) which extends through an opening (20) of the bottom (3) and cooperates with a groove (22) on the outer peripheral surface (23) of the cam (5), wherein the groove (22) extends over the entire outer peripheral surface (23) of the cam (5) with the exception of a base circle region $\alpha$, and the groove (22) has a depth so that the adjusting element (21) extending in the groove (22) releases the closing member (16) so that the closing member (16) bears against the passage (19) due to the force of the spring means (17), the force of the spring means (17) has a magnitude so that for opening the closing member (16) during contact of the base circle region $\alpha$ of the cam (5), a hydraulic medium differential pressure of $\Delta p \geqq 0.4$ bar is required at the cross-section A of the passage (19); and a closing ramp ($\beta$) adjoining a run-off flank ($\gamma$) of the cam (5), as seen in rotating direction of the cam (5), has a height of <0.1 mm.

3. A tappet according to claim 1, characterized in that the spring means (17) is a coiled spring and the one-way valve (15) is a ball valve.

4. A tappet according to claim 1, characterized in that the opening (20) is simultaneously configured as an air vent for the reservoir (14).

5. A tappet according to claim 1, characterized in that, starting from a valve-proximate end, the adjusting element (21) has a conical shape, a partly conical shape, or an increasing diameter.

6. A tappet according to claim 1, characterized in that the adjusting element (21) is a pin or a pin-like element.

7. A tappet according to claim 1, characterized in that the adjusting member (21) is connected at its outer peripheral surface (24) within the reservoir (14) to a securing element (25).

8. A tappet according to claim 7, characterized in that the securing element (25) is a spring which is supported on the undersurface (6) of the bottom (3), and the force of this spring is clearly smaller than the force of the spring means (17).

9. A tappet according to claim 7, characterized in that the securing element (25) is made as a Belleville-type spring washer or as a disk.

* * * * *